US007048605B2

(12) United States Patent
Hawthorne et al.

(10) Patent No.: US 7,048,605 B2
(45) Date of Patent: May 23, 2006

(54) BOBBLE HEAD SHAKER

(76) Inventors: Grant Hawthorne, 4230 Abbott Ave. S., Minneapolis, MN (US) 55410-1410; David Kapell, 2148 Summit Ave., Minneapolis, MN (US) 55405; Andrew Comfort, 2886 James Ave. S., #201, Minneapolis, MN (US) 55408-1839; Thomas Cheung, 8E, YYC Ind. Building, 20 Wang Hoi Road, Kowloon Bay, Hong Kong (CN); Gan Wei Xiong, Yin Keng Ind. Area, Shang Yuan, Qing Xi, Dongguan (CN); Liao Wang Xian, #1 An Yan Road, Ma Ah Shan Ind. Area, Sha Jin, Bao An, Shenzhen (CN); Lowell Fritzke, 14001 Vale Ct., Eden Prairie, MN (US) 55364

( * ) Notice: Subject to any disclaimer, the term of this patent is extended or adjusted under 35 U.S.C. 154(b) by 74 days.

(21) Appl. No.: 10/723,453

(22) Filed: Nov. 25, 2003

(65) Prior Publication Data

US 2005/0112984 A1 May 26, 2005

(51) Int. Cl.
*A63H 13/00* (2006.01)

(52) U.S. Cl. ..... 446/358; 446/352; 446/359

(58) Field of Classification Search ..... 446/384, 446/268, 330, 331, 335, 338, 352, 353, 358, 446/379, 73, 354, 359, 361, 364, 391, 484; 40/411, 414, 418–420
See application file for complete search history.

(56) References Cited

U.S. PATENT DOCUMENTS 2,368,088 A * 1/1945 Brewer ..... 273/161
2,453,646 A * 11/1948 Tomlin et al. ..... 446/331
3,643,374 A * 2/1972 Gunther et al. ..... 446/358
4,497,581 A 2/1985 Miller
4,662,760 A 5/1987 Powell
4,824,416 A * 4/1989 Chun-Hoi et al. ..... 446/298
4,842,415 A 6/1989 Cane et al.
4,852,283 A * 8/1989 Teng ..... 40/426
5,050,996 A 9/1991 Allen
5,209,692 A * 5/1993 Coleman et al. ..... 446/71
5,316,516 A * 5/1994 Saitoh ..... 446/175
5,503,474 A 4/1996 Krzywdziak (Continued)

OTHER PUBLICATIONS

Fans go Crazy Over Alexander's Bobble Dobble Dolls, *Puget Sound Business Journal*, Oct. 21, 2002, 4 pages.

*Primary Examiner*—Jacob K. Ackun
*Assistant Examiner*—J Williams
(74) *Attorney, Agent, or Firm*—Merchant & Gould PC

(57) ABSTRACT

A bobble head doll shaker includes a base and housing and a supporting platform that is hingedly mounted to the housing. A motor drives an agitator that lifts and releases the supporting platform, thereby imparting an oscillating motion to a bobble head doll supported on the platform. The agitator includes engagement portions that lift the supporting platform. The motor has variable speed and agitator elements having different profiles that may be interchanged to achieve a greater variability of the oscillating motion. Moreover, with the hinge attachment, the bobble head doll's position and corresponding movement may be varied by changing its location on the supporting platform. A riser element may also be placed under the doll to increase the instability of the doll and provide for further varying the bobble head doll motion.

21 Claims, 6 Drawing Sheets

U.S. PATENT DOCUMENTS 5,865,336 A 2/1999 Krzywdziak et al.
6,185,849 B1 * 2/2001 Liu ..... 40/411
6,302,575 B1 10/2001 Anderson et al.
6,551,359 B1 * 4/2003 Lang et al. ..... 8/405
6,802,755 B1 * 10/2004 Walker et al. ..... 446/175
6,840,838 B1 * 1/2005 Reid et al. ..... 446/331

* cited by examiner

BOBBLE HEAD SHAKER

BACKGROUND OF THE INVENTION

1. Field of the Invention

The present invention relates to a shaker device, and in particular to a shaker device used for shaking bobble head dolls to impart a continuous oscillating motion causing the head of the doll to bobble.

2. Description of the Prior Art

Bobble heads have existed for many years and provide entertainment from the amusing shaking motion of the doll's head. Bobble head dolls have become quite popular and collectible, however it has been necessary to manually deflect the base of the doll or the doll's head to impart a bobbing motion. However, such motion discontinues after a short period of time and repeated manual agitations of the base or taps to the head of the doll are not practical in order to achieve a pleasing and entertaining continuous motion. It can be appreciated that bobble head dolls are often displayed in prominent positions wherein continuous motion of an extended duration is desirable. Therefore, a need arises not only for a device that imparts an oscillating motion to cause the head to bobble, but for such a device to be a particular size that accommodates the bobble head while providing an overall pleasing display of the doll sitting upon the shaker. Moreover, the shape, size, and quality of bobble head dolls vary so that different frequencies and motions are needed to impart a pleasing bobbling motion to the dolls' heads for a wide range of dolls. The shaker apparatus needs to be able to impart a proper variable frequency to accommodate the various shapes, sizes and weights of bobble head dolls.

It can be seen then that a bobble head shaker is needed that provides a pleasing and continuous bobbing motion to the head of a bobble head doll. The present invention provides for imparting the bobbing motion to the doll's head and for accommodating various different kinds of bobble head dolls. In addition, such a shaker should provide for easy variability of imparted bobbing motion to the head of the doll while also providing a pleasing overall appearance as a display platform for the doll. The present invention addresses these as well as other problems associated with bobble head doll shaking.

SUMMARY OF THE INVENTION

The present invention is directed to a bobble head shaker apparatus for imparting an oscillating motion to the head of the bobble head doll. The shaker generally includes a base and housing with a moving platform having an upper bobble head doll supporting surface that imparts a motion to the doll causing the head to bobble. The housing generally includes a motor and an agitator that engages the underside of the platform. The motor is preferably adjustable so that oscillation speed may be adjusted to optimize the speed needed for achieving the desired motion of the bobble head doll head. The motor typically drives an agitator that engages the platform to impart the oscillating motion through engagement elements that engage complementary elements extending down from the underside of the moving platform. Different agitators may be interchanged so that other agitators having fewer or more engagement elements and taller or shorter engagement elements may be utilized to further vary the motion of the supporting base.

The supporting platform has an upper surface larger than the base of the bobble head doll. The platform is hingedly connected at one edge and includes a latch at the opposite edge to provide access to the interior of the shaker apparatus to interchange agitators or make other adjustments. The platform imparts a greater motion at the edge opposite the hinge than near the hinge. The bobble head doll head motion may therefore be varied by moving the bobble head doll on the platform relative to the hinge. In addition, the surface is preferably a semi-adhesive surface so that the bobble head doll does not slide from vibration. A small riser element may be selectively used that raises an edge of the bobble head doll base, thereby increasing the doll's instability on the supporting platform producing alternative oscillating motions to the doll's head. By utilizing such a riser element, the doll will not set flush on the supporting platform and may roll slightly, increasing and/or changing the produced head bobbing motion.

It can be appreciated that by varying the position of the doll on the supporting platform, and/or by varying the oscillation speed of the supporting platform and the amplitude of the up and down motion, the motion of the bobbling head may be varied to achieve a desired motion. Moreover, if additional motion is needed, a small semi-adhesive riser element may be placed between the base of the bobble head doll and the supporting platform to elevate one edge of the bobble head doll's base, thereby enabling additional bobbling motions to be imparted by the movements of the supporting platform. By changing the various parameters, a pleasing and entertaining oscillating motion of the bobble head doll's head may be achieved for a wide range of dolls having different characteristics.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings wherein like reference numerals indicate corresponding structure throughout the several views.

DETAILED DESCRIPTION OF THE PREFERRED EMBODIMENT

Figure 1:
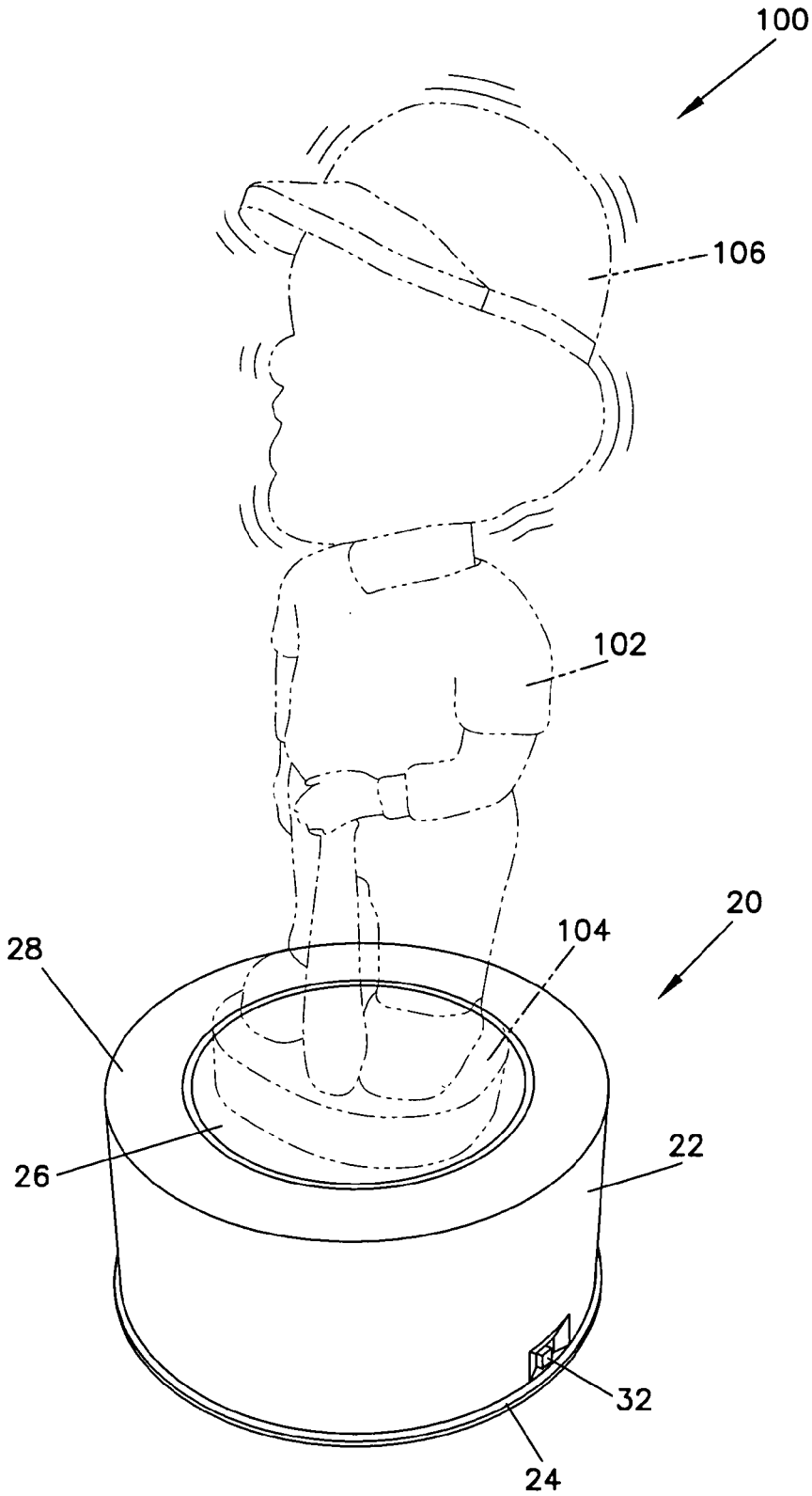
FIG. 1 is a perspective view of a bobble head shaker apparatus and a bobble head according to the principles of the present invention.

Referring now to the drawings, and in particular to FIG. 1, there is shown a bobble head shaker apparatus, generally designated 20 and supporting a bobble head doll, generally designated 100. The bobble head doll 100 typically includes a body 102 with a base 104. A head 106 is supported on the body 102 by a spring such that when the head 106 is touched, motion is imparted and the head will tend to "bobble" in an amusing/entertaining oscillating motion. Bobble head dolls 100 often are caricatures of sports figures or other celebrities and are highly collectible. It is often desired to display the bobble head dolls 100 so that the head 106 bobbles continuously for a certain period of time. It is also often desired that the bobble head dolls be pleasingly and attractively displayed for viewing without being in motion.

Figure 6:
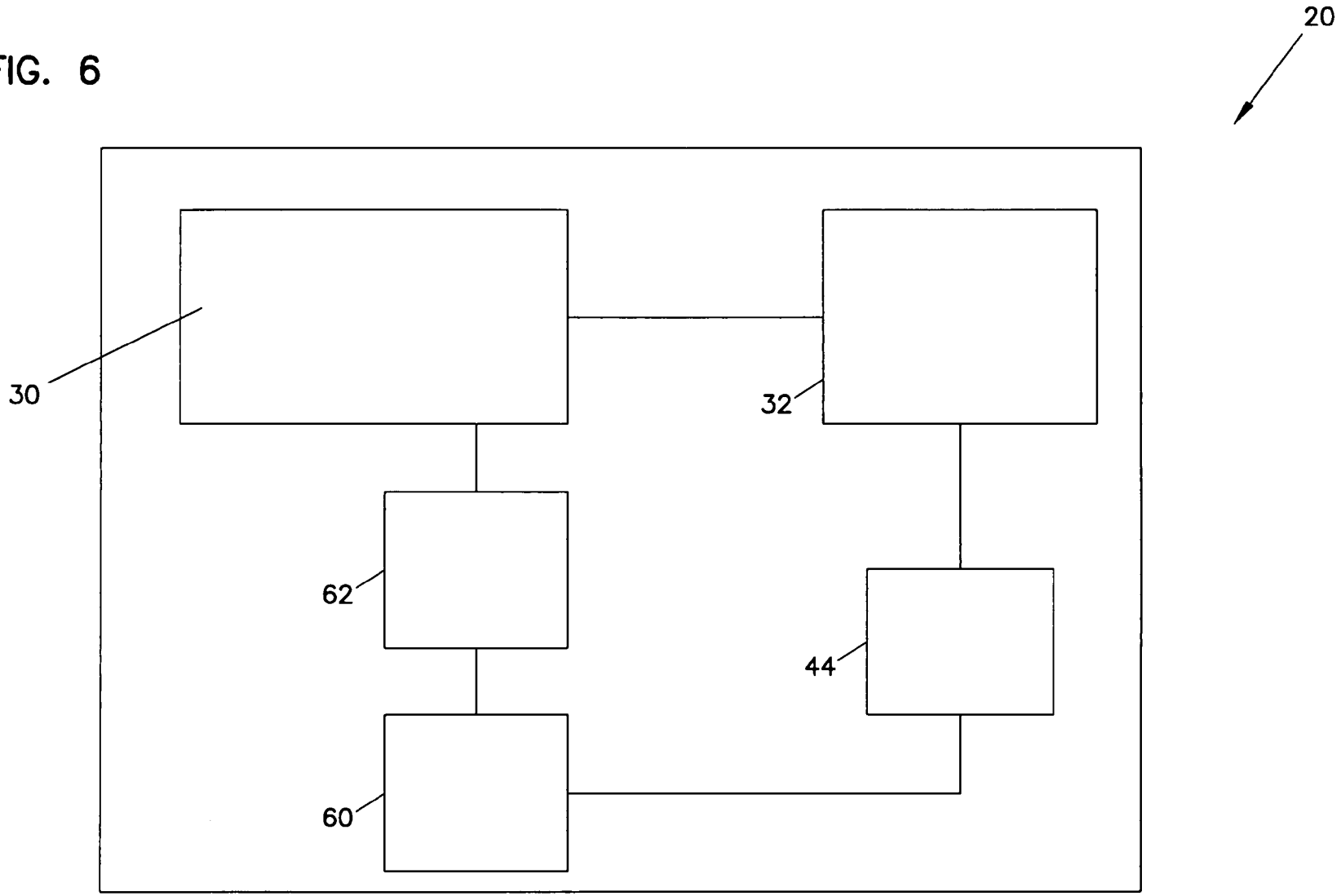
FIG. 6 is a control diagram for the shaker apparatus shown in FIG. 1.

The shaker apparatus 20 provides for imparting a continuous motion to the bobble head 106, and for pleasingly displaying a bobble head doll 100 at rest. The shaker apparatus 20 generally includes a compact housing 22 having a rim 28 and mounted on a base 24. A round platform 26 supports the bobble head doll 100 and is moveable as explained hereinafter to impart motion to the bobble head doll 100 and bobble the doll's head 106. The shaker 20 generally also includes a motor 30. The motor 30 may include a power source such as a battery compartment 44 receiving batteries, a battery pack, or may include a cord for plugging into an AC outlet, such as is well known in the art. As shown in FIG. 6, the control system may also include a speed control 60, such as a rheostat, to vary the speed of oscillation, a switch 32 for turning the shaker 20 on and off, and an actuator 62 so that the shaker 20 will turn on at selected times. This allows for selectively having continuous motion, but saving power while people are not present. The actuator 62 may be a remote control, a sound detector or other well known actuator.

Figure 2:
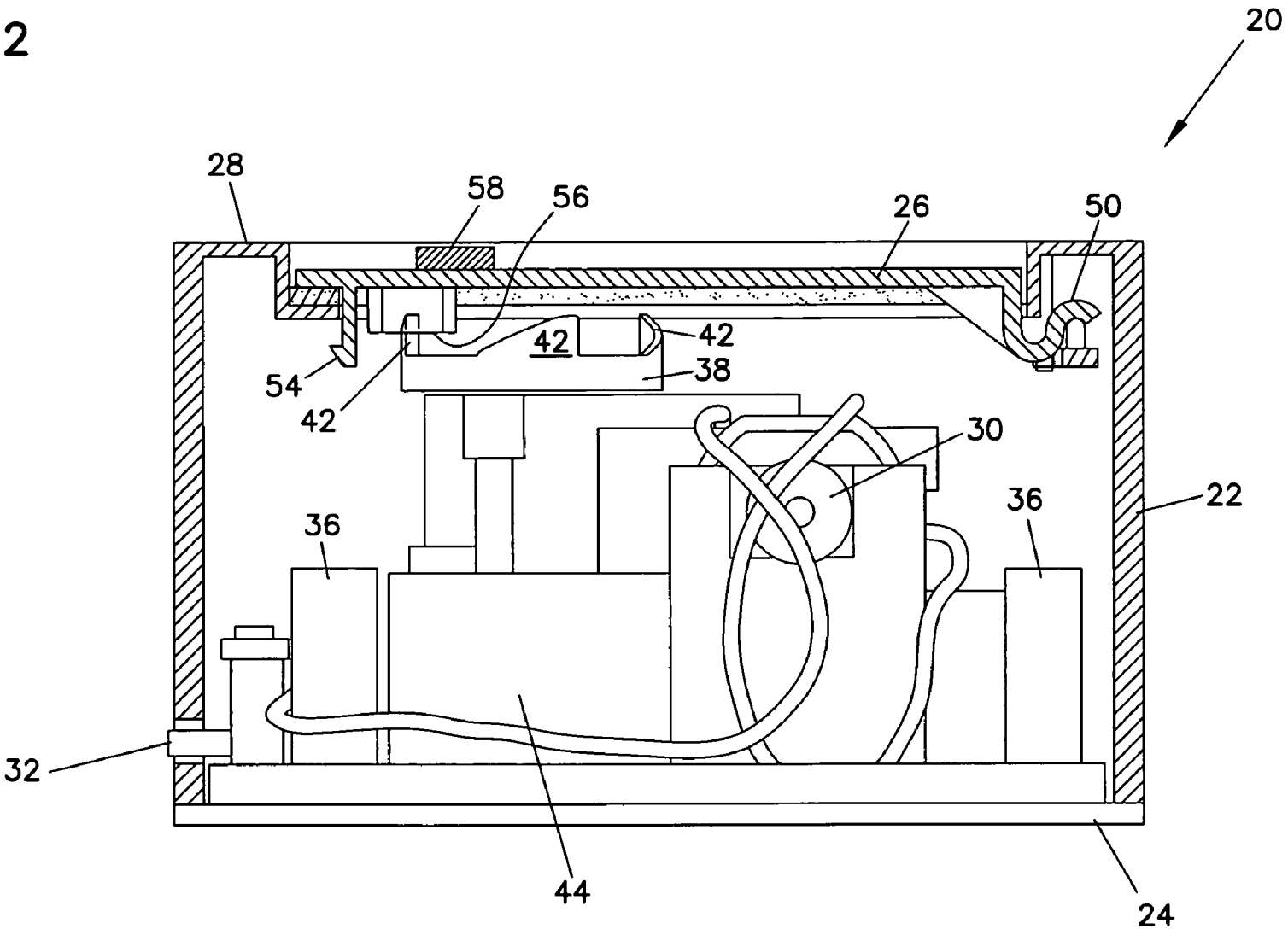
FIG. 2 is a side sectional view of the shaker apparatus shown in FIG. 1.
Figure 3:
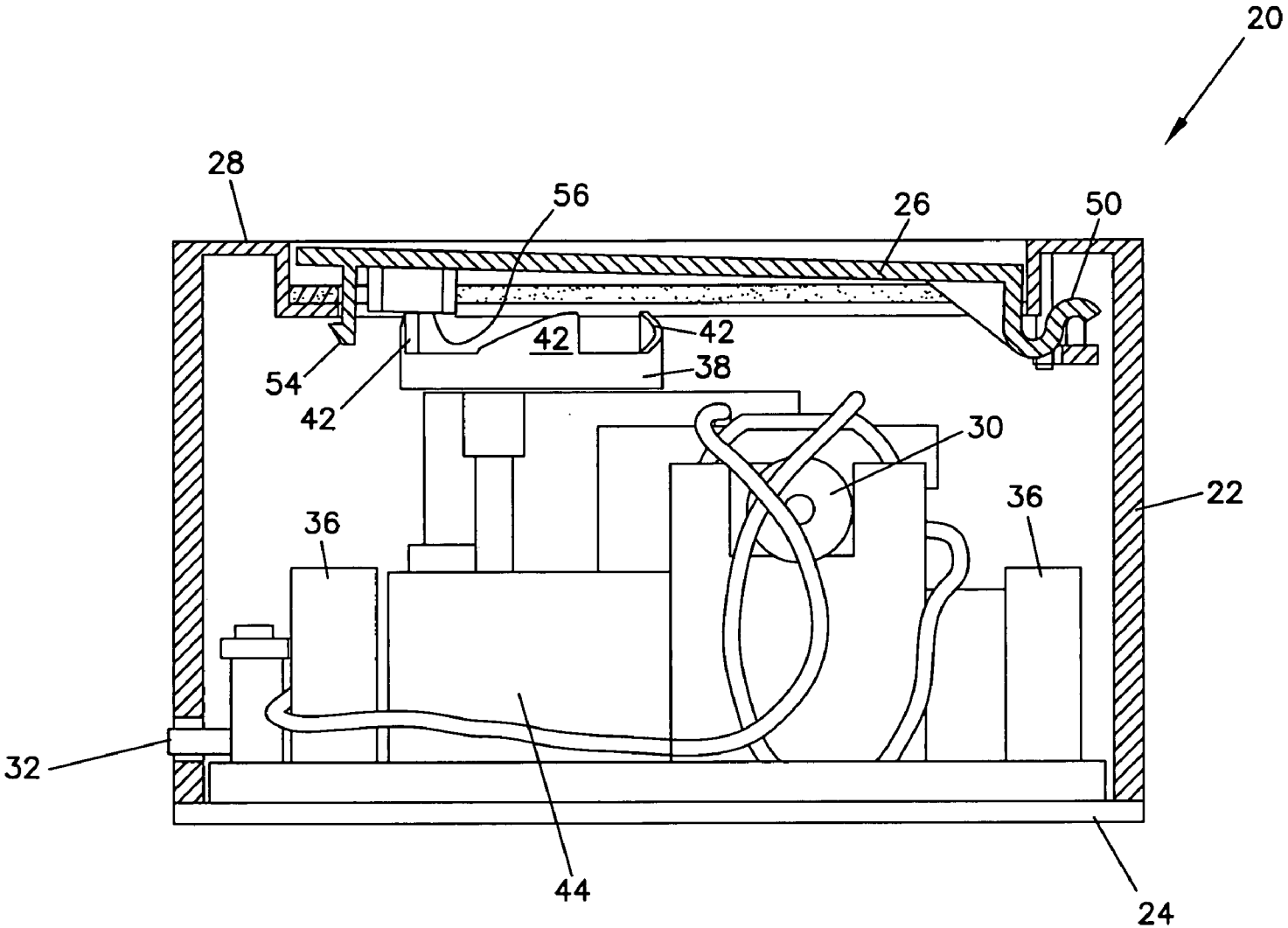
FIG. 3 is a side sectional view of the shaker apparatus shown in FIG. 3 with the moving base raised.
Figure 4:
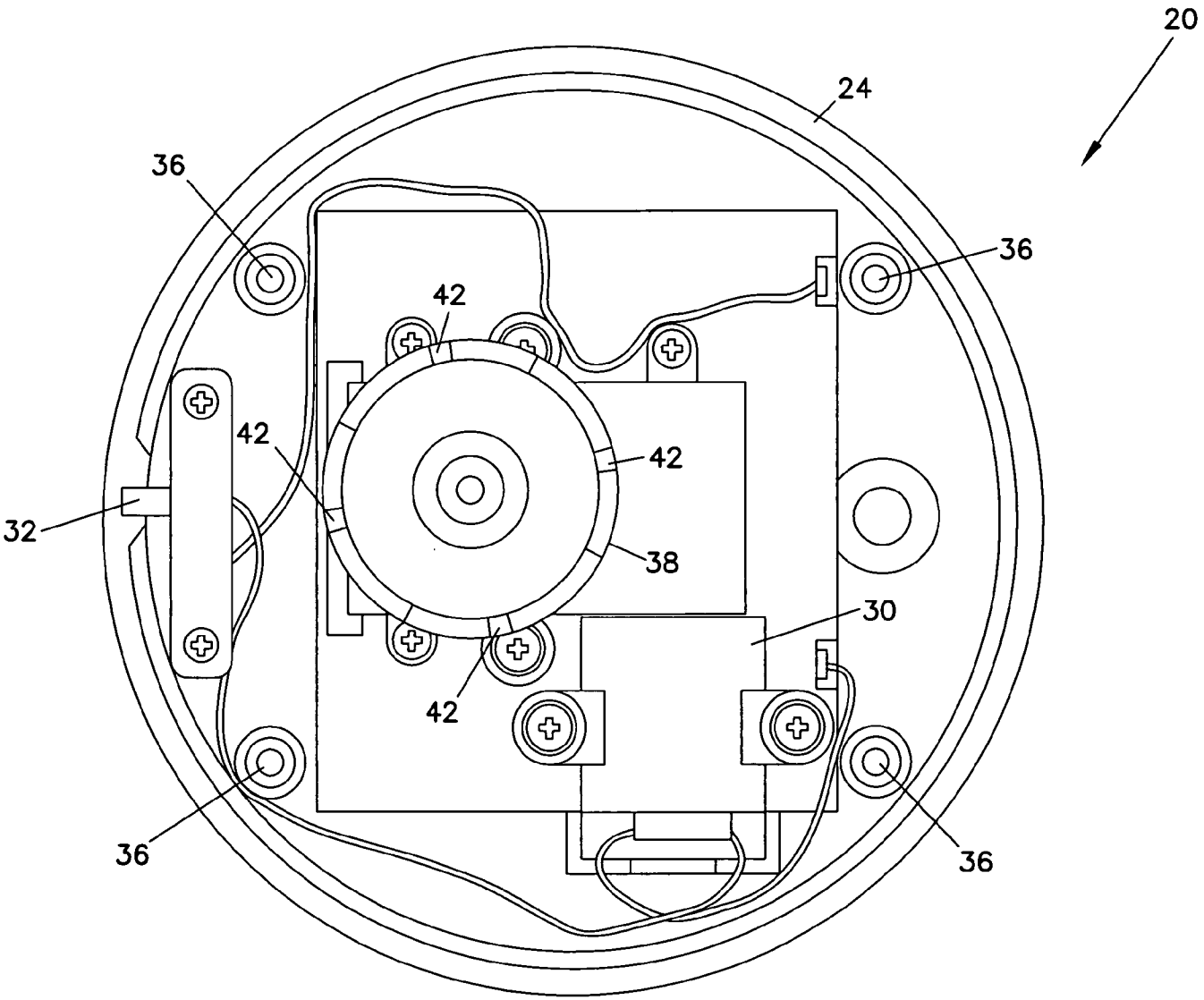
FIG. 4 is a top plan view of the shaker mechanism.
Figure 5:
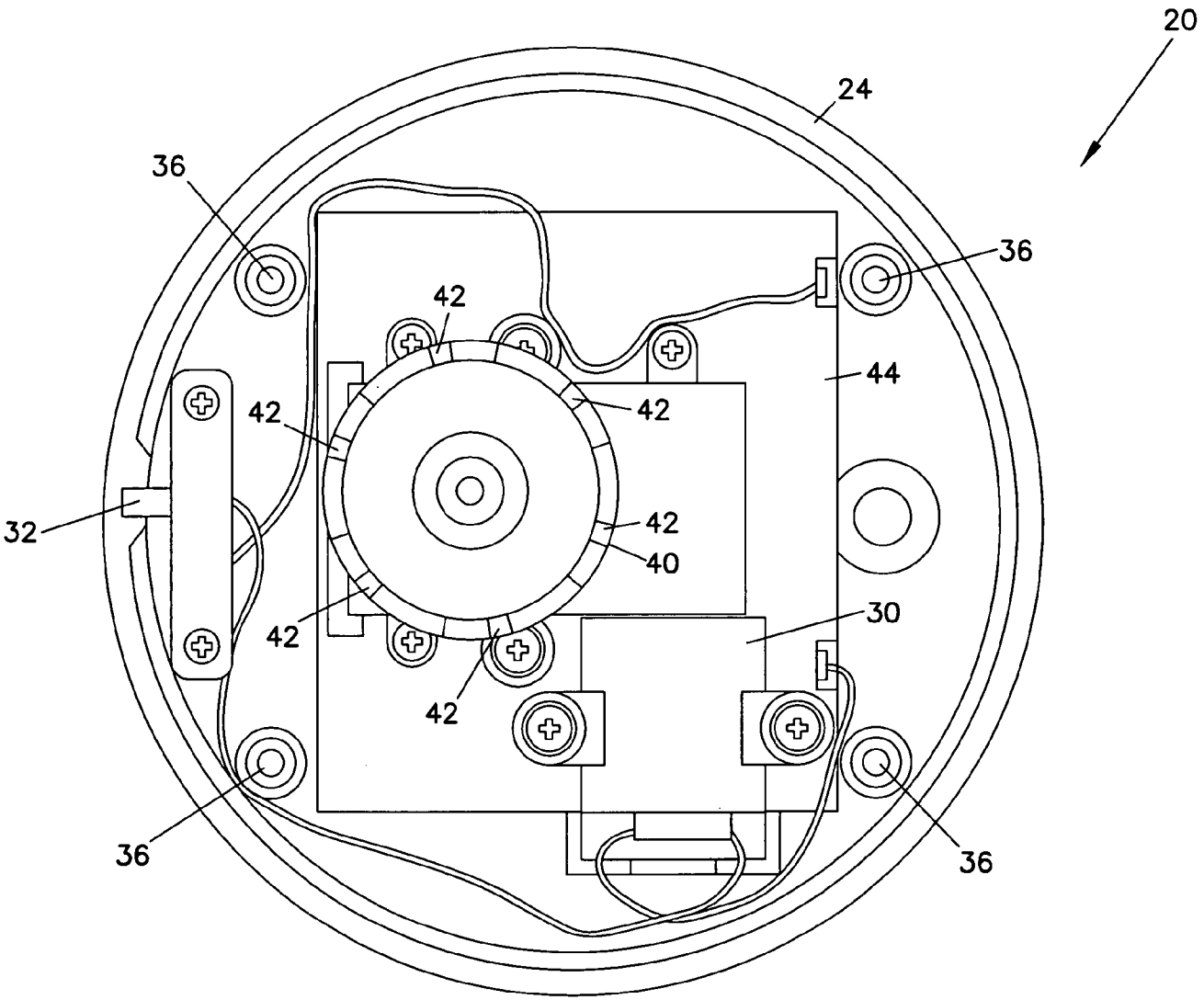
FIG. 5 is a detail view of an alternate embodiment of an agitator element for imparting motion a different motion.

Referring to FIGS. 2 and 3, the housing 22 and base 24 contain the motor 30 and are connected by screws attaching to alignment members 36. A removable and interchangeable agitator 38 is driven by the motor 30 and engages the moving platform 26. It can be appreciated that in order to vary amplitude and/or frequency of the oscillations, other agitators 40 may be stored in the housing 22 and may be interchanged with the agitator 38, as shown in FIG. 5. The agitators 38 and 40 include ramped engagement portions 42 that engage and lift a complementary engagement member portion 56 on the platform 26, as explained hereinafter to impart motion to the platform 26 and oscillation to the bobble head doll 100. It can be appreciated that by varying the number of engagement portions 42 or the height of the engagement portions 42, the type of motion imparted to the bobble head doll 100 may be varied without using a rheostat or other control device. As shown in FIGS. 2–4, the agitator 38 has four engagement portions 42, while the agitator 40 includes six engagement portions, as shown in FIG. 5. The agitator 40 will cause an up and down frequency one and a half times the frequency of the agitator 40. It can be appreciated that other agitators having fewer or more engagement portions 42 and/or different profiles may also be used to achieve other frequencies and motions.

As shown in FIGS. 2 and 3, the platform 26 mounts to the housing 22 on a hinge 50. A latch 54 that may be released to access the interior of the housing 22 retains the platform 26 at an opposite edge. Such access allows for users to change agitators and for storage of alternate agitators within the housing 22. The moving platform 26 also includes damping foam 52 placed intermediate the housing 22 and the platform 26 to decrease noise and soften the oscillating motion. The underside of the platform 26 includes an agitator engagement portion 56 extending downward. The agitator engagement portion 56 engages the complementary engagement portions 42 from the agitator 38 so that when the two portions are engaged, the platform 26 is pivoted upward, as shown in FIG. 3. When the engagement portions 42 and 56 disengage, the platform 26 drops down again, as shown in FIG. 2. This engagement and disengagement imparts a continuous up and down motion to the platform 26. It can be appreciated that with the hinge connection 50 between the platform 26 and the housing 22, the oscillating motion is oriented along an axis rather than a straight up and down motion. This provides a slight tilt to the bobble head doll 100 while imparting the bobbling motion. It has been found that such a motion also imparts greater amplitude further from the hinge 50 than closer to the hinge 50. This allows for changing the position of the bobble head doll 100 on the platform 26 or rotating the doll's base 104 on the platform 26 to arrive at a position wherein the preferred oscillating motion is achieved. The overall amplitude can be increased or decreased simply by moving the bobble head doll 100. This is important for optimizing motions of dolls 100 having different densities, weights and sizes.

In addition, it has been found that bobbling may, in some instances, be enhanced if the base 104 of the bobble head doll 100 is not sitting flush on the platform 26. As shown in FIG. 2, a small removable riser element 58 may be placed on the platform 26 to raise up one edge of the base 104. Such an element 58 makes the bobble head doll 100 slightly less stable and affects the motion of the bobble head doll 100. It can be appreciated that the element 58 may be somewhat adhesive so that the bobble head doll 100 is held in place. Moreover, the platform 26 may also have a non-slip upper surface so that the bobble head doll 100 does not move from its preferred position by vibration. Furthermore, the shaker apparatus 20 is stabilized by semi-adhesive feet attached to the bottom of the base 24 that will prevent the shaker 20 from moving on the surface on which it has been placed, and which will increase the energy of motion imparted by the shaker's active operation to the bobble head doll 100 in place upon it.

It can be appreciated that with the varied amplitude by moving the position and/or orientation of the doll 100 on the platform 26, the ability to increase the instability of the doll 100 by adding an element 58 and the variability by changing the amplitude and speed with a different agitator or rheostat, the present invention provides for achieving a bobble head motion that meets the needs of a wide range of bobble head dolls.

In use, the bobble head doll 100 is placed on the moving platform 26 inside the rim 28 of the housing 22 as shown in FIG. 1. The switch 32 is then actuated. The motor 30 rotates the agitator 38. The engagement portions 42 of the agitator element 38 engage and lift the agitator engagement portion 56 of the platform 26. This causes the platform 26 and the bobble head doll 100 to rise and fall, as shown in FIGS. 2 and 3. This motion imparts a bobbling motion to the bobble head doll head 106.

If the motion is too fast, too slow, too great or too slight, adjustments may be made. For example, the rheostat 60 may be utilized to speed up or slow down the speed of the motor and therefore the frequency of the up and down motion of the platform 26. In addition, a different agitator 40 having fewer or more engagement portions 42 or having different profiles may be substituted for the agitator 38. Moreover, the position of the bobble head doll 100 on the platform 26 may be moved closer or further from the hinge 50 so that the total up and down travel distance of the bobble head doll 100 is increased or decreased. The orientation of the doll 100 may also be changed by simply rotating the doll 100. Furthermore, an element 58 may be inserted under one edge of the bobble head base 104 to impart additional instability to the bobble head doll 100 and increase the motion of the doll.

Various adjustments may be made to each of these features until the desired bobbling motion of the doll's head 106 is achieved. It has been found that typical bobble head dolls 100 achieve a pleasing bobbling motion when the frequency of the platform 26 is in the range of 20 to 50 cycles per minute. It can be appreciated that the various parameters may be mixed and matched to achieve a wide range of amplitudes and frequencies and corresponding motions.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A bobble head doll shaker, comprising:

a base;

a motor, a bobble head doll support;

an agitation assembly including an agitator driven by the motor and imparting a shaking motion to the bobble head support, and interchangeable agitator elements having different profiles, imparting different motions to the bobble head doll support.

2. A shaker according to claim 1, wherein the agitator comprises a rotating agitator engaging the bobble head support.

3. A shaker according to claim 2, wherein the agitator engages an underside of the bobble head support.

4. A shaker according to claim 1, wherein the bobble head shaking motion has a frequency of 20 to 50 cycles per minute.

5. A shaker according to claim 1, wherein the bobble head support comprises a damping element.

6. A shaker according to claim 1, wherein support comprises a rounded footprint.

7. A shaker according to claim 6, wherein the support comprises a round footprint.

8. A shaker according to claim 1, wherein the bobble head support and the base comprise complementary alignment elements.

9. A shaker according to claim 1, wherein the shaking motion is variable.

10. A shaker according to claim 1, further comprising an actuator.

11. A shaker according to claim 10, wherein the actuator comprises a sound activator.

12. A shaker according to claim 1, further comprising a speed control.

13. A shaker according to claim 1, wherein the speed control comprises a rheostat.

14. A shaker according to claim 1, wherein the support comprises a raised element positioned to engage and lift a portion of a bottom of a bobble head doll.

15. A shaker according to claim 14, wherein the raised element comprises a nonskid surface.

16. A shaker according to claim 1, further comprising a damper on the support engaging the base.

17. A bobble head doll shaker, comprising:

a base;

a motor, a bobble head doll support platform;

an agitation assembly including agitator driven by the motor and imparting a shaking motion to the platform;

wherein the platform is pivotally connected to the base.

18. A shaker according to claim 17, wherein the bobble head support platform comprises a releasable latch opposite the pivotal connection.

19. A bobble head doll shaker, comprising:

a base;

a motor, a bobble head doll support;

an agitation assembly including an agitator driven by the motor and imparting a shaking motion to the bobble head support and interchangeable agitator elements, and wherein the motor is variable speed.

20. A shaker according to claim 19, wherein the bobble head doll support comprises a platform pivotally connected to the base.

21. A shaker according to claim 20, further comprising a lift element mounted to the platform.

* * * * *